US007245066B2

(12) United States Patent
Kawaguchi et al.

(10) Patent No.: US 7,245,066 B2
(45) Date of Patent: Jul. 17, 2007

(54) FLAT PANEL DISPLAY SPACER, METHOD OF MANUFACTURING FLAT PANEL DISPLAY SPACER, AND FLAT PANEL DISPLAY

(75) Inventors: Yukio Kawaguchi, Chuo-ku (JP); Atsushi Hitomi, Chuo-ku (JP); Kazumitsu Tanaka, Chuo-ku (JP); Takao Matsumoto, Chuo-ku (JP); Masahiro Itoh, Chuo-ku (JP); Kenichi Jinguji, Chuo-ku (JP); Tsutomu Koyanagi, Chuo-ku (JP); Katsuyuki Kurachi, Chuo-ku (JP)

(73) Assignee: TDK Corporation, Tokyo (JP)

( * ) Notice: Subject to any disclaimer, the term of this patent is extended or adjusted under 35 U.S.C. 154(b) by 2 days.

(21) Appl. No.: 10/568,494

(22) PCT Filed: Jul. 28, 2004

(86) PCT No.: PCT/JP2004/010733

§ 371 (c)(1),
(2), (4) Date: Feb. 16, 2006

(87) PCT Pub. No.: WO2005/017940

PCT Pub. Date: Feb. 24, 2005

(65) Prior Publication Data

US 2007/0024171 A1 Feb. 1, 2007

(30) Foreign Application Priority Data

Aug. 19, 2003 (JP) ..... 2003-295572

(51) Int. Cl.
*H01J 1/88* (2006.01)
*H01J 9/00* (2006.01)
*H01J 9/24* (2006.01)

(52) U.S. Cl. ..... 313/292; 445/23; 445/66; 501/46

(58) Field of Classification Search ..... 313/292, 313/238, 495–497; 445/23–25, 66; 501/46, 501/48, 903
See application file for complete search history.

(56) References Cited

U.S. PATENT DOCUMENTS

| | | | |
|---|---|---|---|
| 5,541,473 | A | 7/1996 | Duboc, Jr. et al. |
| 6,064,157 | A | 5/2000 | Spindt et al. |

FOREIGN PATENT DOCUMENTS

| | | |
|---|---|---|
| JP | A 11-500856 | 1/1999 |
| JP | A 2001-068042 | 3/2001 |
| JP | A 2001-508926 | 7/2001 |
| JP | A 2002-508110 | 3/2002 |
| JP | A 2002-515133 | 5/2002 |
| JP | A 2004-018296 | 1/2004 |
| JP | A 2004-146352 | 5/2004 |
| WO | WO 96/30926 | 10/1996 |
| WO | WO 98/03986 | 1/1998 |
| WO | WO 99/00818 | 1/1999 |
| WO | WO 99/01891 | 1/1999 |

*Primary Examiner*—Joseph Williams
(74) *Attorney, Agent, or Firm*—Oliff & Berridge, PLC

(57) ABSTRACT

A flat panel display spacer has a sintered body containing $A1_2O_3$, TiC, MgO, and $TiO_2$, whereas the sintered body includes 35 to 55 wt % of MgO with respect to the total weight of $A1_2O_3$, TiC, MgO, and $TiO_2$.

6 Claims, 17 Drawing Sheets

Fig.14

| | COMPOSITION (wt %) | | | | COEFFICIENT OF THERMAL EXPANSION(CTE) (1/°C) | RESISTIVITY (Ω·cm) | 3-POINT BENDING STRENGTH (MPa) |
|---|---|---|---|---|---|---|---|
| | MgO | $TiO_2$ | TiC | $Al_2O_3$ | | | |
| EXAMPLE 1 | 35.0 | 2.5 | 7.0 | 55.5 | $8.1 \times 10^{-6}$ | $1.0 \times 10^{9}$ | 450 |
| EXAMPLE 2 | 40.0 | 2.5 | 7.0 | 50.5 | $8.5 \times 10^{-6}$ | $1.0 \times 10^{9}$ | 450 |
| EXAMPLE 3 | 45.0 | 2.5 | 7.0 | 45.5 | $8.8 \times 10^{-6}$ | $1.0 \times 10^{9}$ | 450 |
| EXAMPLE 4 | 50.0 | 2.5 | 7.0 | 40.5 | $9.0 \times 10^{-6}$ | $1.0 \times 10^{9}$ | 450 |
| EXAMPLE 5 | 55.0 | 2.5 | 7.0 | 35.5 | $9.3 \times 10^{-6}$ | $1.0 \times 10^{9}$ | 450 |
| EXAMPLE 6 | 40.0 | 1.5 | 7.0 | 51.5 | $8.5 \times 10^{-6}$ | $1.0 \times 10^{12}$ | 450 |
| EXAMPLE 7 | 40.0 | 2.0 | 7.0 | 51.0 | $8.5 \times 10^{-6}$ | $5.0 \times 10^{10}$ | 450 |
| EXAMPLE 8 | 40.0 | 3.0 | 7.0 | 50.0 | $8.5 \times 10^{-6}$ | $5.0 \times 10^{7}$ | 450 |
| EXAMPLE 9 | 40.0 | 3.5 | 7.0 | 49.5 | $8.5 \times 10^{-6}$ | $1.0 \times 10^{6}$ | 450 |
| EXAMPLE 10 | 40.0 | 2.5 | 6.0 | 51.5 | $8.5 \times 10^{-6}$ | $1.0 \times 10^{9}$ | 420 |
| EXAMPLE 11 | 40.0 | 2.5 | 8.0 | 49.5 | $8.5 \times 10^{-6}$ | $1.0 \times 10^{9}$ | 450 |
| EXAMPLE 12 | 40.0 | 2.5 | 9.0 | 48.5 | $8.5 \times 10^{-6}$ | $1.0 \times 10^{9}$ | 420 |
| COMPARATIVE EXAMPLE 1 | 30.0 | 2.5 | 7.0 | 60.5 | $7.7 \times 10^{-6}$ | $1.0 \times 10^{9}$ | 450 |
| COMPARATIVE EXAMPLE 2 | 60.0 | 2.5 | 7.0 | 30.5 | $9.5 \times 10^{-6}$ | $1.0 \times 10^{9}$ | 450 |

FLAT PANEL DISPLAY SPACER, METHOD OF MANUFACTURING FLAT PANEL DISPLAY SPACER, AND FLAT PANEL DISPLAY

TECHINICAL FIELD

The present invention relates to a flat panel display spacer, a method of manufacturing a flat panel display spacer, and a flat panel display.

BACKGROUND ART

Known as a flat panel display of self emission type applying a conventional cathode ray tube (CRT) is a so-called field emission display (FED). An example of such a flat panel display is disclosed in Patent Document 1. This flat panel display comprises a cathode structure in which a number of cathodes (field emission devices) are arranged two-dimensionally, whereas electrons released from the cathodes in an environment under a reduced pressure are caused to impinge on individual fluorescent pixel areas, so as to form emission images. The fluorescent pixel areas contain a phosphorus layer.

Such a flat panel display includes a backplate having the cathode structure. The backplate is formed by depositing the cathode structure on a glass sheet.

Such a flat panel display also includes a faceplate in which a phosphorus layer is deposited on a glass sheet. A conductive layer for applying an electric field is deposited on the glass sheet or phosphorus layer of the faceplate. The faceplate is separated from the backplate by 0.1 mm to 1 mm or 2 mm. A strip-like spacer made of a wall is vertically interposed between the faceplate and the backplate.

Since a high voltage of 1 kV or more, for example, is applied between the faceplate and the backplate, the spacer is required to have a resistance to the high voltage and such an appropriate conductivity as to prevent it from being electrostatically charged. Conventionally known spacers include those in which insulative materials made of alumina are coated with conductive materials (see, for example, Patent Documents 2, 3), those having uneven films formed by fine particles of oxides and the like (see, for example, Patent Document 4), and those made of ceramics in which transition metal oxides are dispersed (see, for example, Patent Documents 5, 6).

Patent Document 1: U.S. Pat. No. 5,541,473

Patent Document 2: Japanese Translation of International Application Laid-Open No. 2002-508110

Patent Document 3: Japanese Translation of International Application Laid-Open No. 2001-508926

Patent Document 4: Japanese Patent Application Laid-Open No. 2001-68042

Patent Document 5: Japanese Translation of International Application Laid-Open No. HEI 11-500856

Patent Document 6: Japanese Translation of International Application Laid-Open No. 2002-515133

DISCLOSURE OF THE INVENTION

Problem to be Solved by the Invention

However, the coefficient of thermal expansion of conventional flat panel displays is about $7.3\times10^{-6}$/° C. for alumina, for example, thus yielding a large difference from that of the glass material in the faceplate or backplate of the flat panel displays, i.e., 8.0 to $9.3\times10^{-6}$/° C. Therefore, when the temperature of a flat panel display fluctuates within the range of −30 to 50° C., which is regarded as a tolerable environmental temperature of the flat panel display, distortions and the like may occur in the flat panel display because of a large difference in the degree of expansion between the flat panel display and the faceplate and backplate, so that the spacer may misalign or tilt, thereby deflecting released electrons and causing visible defects on the display.

In view of such a problem, it is an object of the present invention to provide a flat panel display spacer having a coefficient of thermal expansion of about 8.0 to $9.3\times10^{-6}$/° C., which is substantially identical to that of a glass material in the faceplate, backplate, and the like; a method of manufacturing the same; and a flat panel display using the same.

Means for Solving Problem

As a result of diligent studies, the inventors have found that a sintered body of mixed ceramics in which $Al_2O_3$ (alumina), TiC (titanium carbide), MgO (magnesium oxide), and $TiO_2$ (titanium dioxide) are mixed at a predetermined ratio yields a coefficient of thermal expansion of about 8.0 to $9.3\times10^{-6}$/° C., and achieved the present invention.

The flat panel display spacer in accordance with the present invention has a sintered body containing $Al_2O_3$, TiC, MgO, and $TiO_2$, wherein the sintered body includes 35 to 55 wt % of MgO with respect to the total weight of $Al_2O_3$, TiC, MgO, and $TiO_2$.

The method of manufacturing a flat panel display spacer in accordance with the present invention comprises the steps of mixing powders of $Al_2O_3$, TiC, MgO, and $TiO_2$ such that the MgO powder is 35 to 55 wt % with respect to the total weight of powders of $Al_2O_3$, TiC, MgO, and $TiO_2$, so as to yield a mixture; and firing the mixture, so as to yield a sintered body.

The flat panel display in accordance with the present invention comprises a backplate including a cathode structure; a faceplate including an optical pixel area; and a flat panel display spacer interposed between the backplate and the faceplate and formed from a sintered body containing $Al_2O_3$, TiC, MgO, and $TiO_2$, wherein the sintered body includes 35 to 55 wt % of MgO with respect to the total weight of $Al_2O_3$, TiC, MgO, and $TiO_2$.

These aspects of the present invention yield a flat panel display spacer made of a ceramic having a coefficient of thermal expansion of about 8.0 to $9.3\times10^{-6}$/° C. Therefore, the coefficient of thermal expansion of the flat panel display spacer can sufficiently approach the coefficient of thermal expansion (8.0 to $9.3\times10^{-6}$/° C.) of a faceplate or backplate made of glass. Consequently, even when temperatures of the faceplate, backplate, and flat panel display spacer in the flat panel display fluctuate, their respective rates of thermal expansion are on a par with each other. Hence, unnecessary distortions are less likely to occur in the flat panel display, whereby the spacer is harder to misalign or tilt. As a result, released electrons are harder to deflect, thereby restraining the display from deteriorating its image quality.

Preferably, the sintered body contains 2.0 to 3.0 wt % of $TiO_2$ with respect to the total weight of $Al_2O_3$, TiC, MgO, and $TiO_2$.

The flat panel display spacer having such a composition yields a resistivity on the order of $1.0\times10^{6}\Omega\cdot$cm to $1.0\times10^{11}\Omega\cdot$cm. Therefore, the flat panel display exhibits an appropriate conductivity, and is less likely to be electrostatically charged when an electric field is applied thereto, while being restrained from causing thermal runaway due to an overcurrent flow, thereby making it possible to further reduce distortions of images and the like in the flat panel display. If the amount of $TiO_2$ is less than 2.0 wt %, the resistivity may be so high that electrostatic charging is likely to occur when an electric field is applied. If the amount of $TiO_2$ exceeds 3.0 wt %, the resistivity may be so low that an overcurrent is likely to flow when an electric field is applied.

Preferably, the sintered body contains 7.0 to 8.0 wt % of TiC with respect to the total weight of $Al_2O_3$, TiC, MgO, and $TiO_2$.

This yields a flat panel display spacer having a sufficient strength while being fully sintered. If the amount of TiC is less than 7.0 wt % here, the rigidity may be so low that the strength tends to decrease. If the amount of TiC exceeds 8.0 wt %, the mixture may be harder to sinter, thereby tending to become fragile and worsen its strength again.

Effect of the Invention

The present invention reduces the deterioration of images in a flat panel display and can improve its image quality.

BRIEF DESCRIPTION OF THE DRAWINGS

FIG. 14 is a table showing the composition, coefficient of thermal expansion, resistivity, and 3-point bending strength in each of Examples 1 to 12 and Comparative Examples 1 and 2;

EXPLANATIONS OF NUMERALS

10 . . . plate; 50 . . . base (sintered body); 100 . . . flat panel display; 101 . . . faceplate; 102 . . . black matrix structure; 103 . . . flat panel display spacer; 105 . . . fluorescent pixel area; 201 . . . backplate; 202 . . . cathode structure.

BEST MODES FOR CARRYING OUT THE INVENTION

In the following, preferred embodiments of the present invention will be explained in detail with reference to the accompanying drawings. In the explanation of the drawings, constituents identical or equivalent to each other will be referred to with numerals identical to each other without repeating their overlapping descriptions.

First, the outline of the flat panel display in accordance with this embodiment will be explained.

Figure 1:
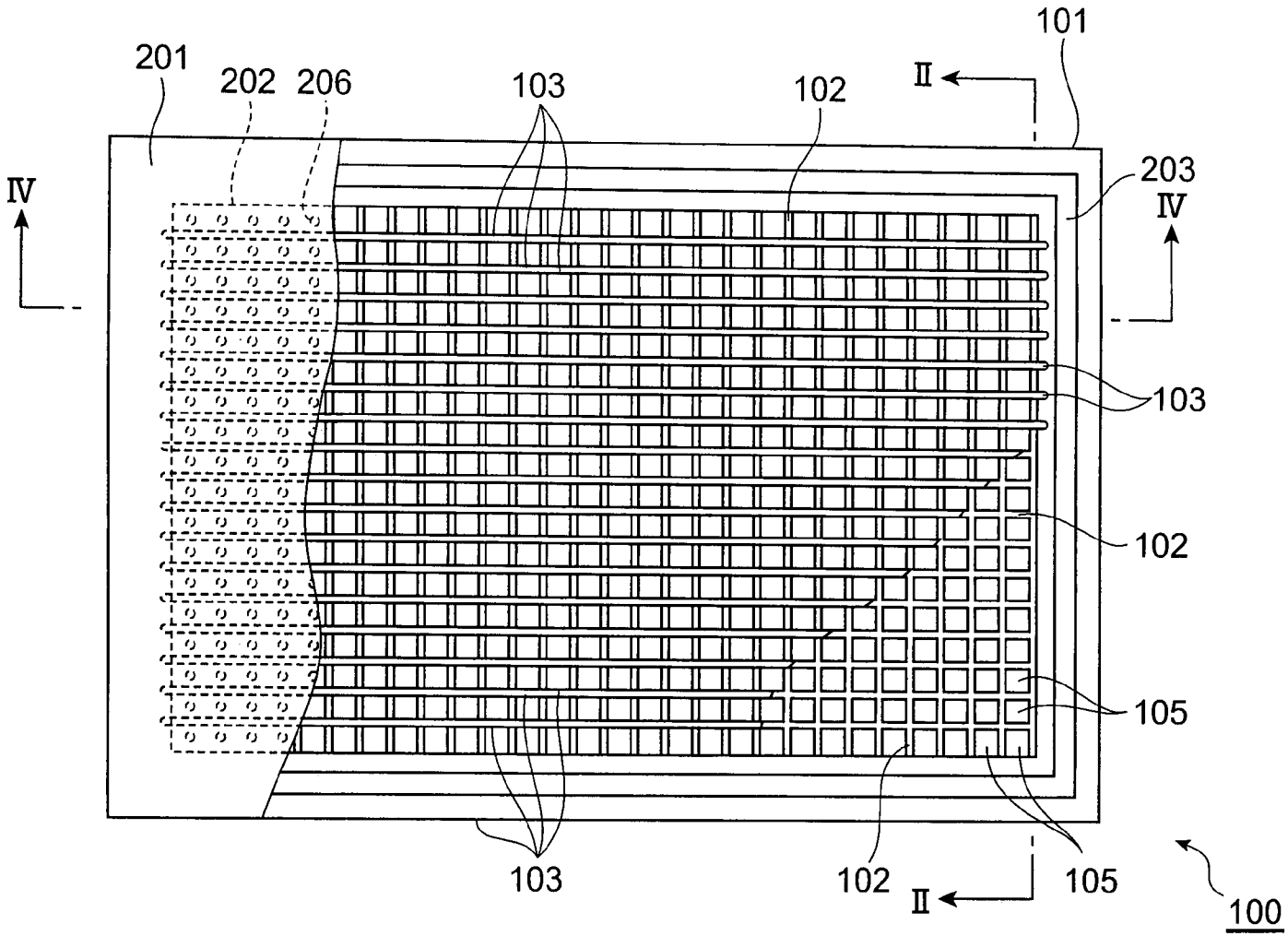
FIG. 1 is a partly broken schematic view of the flat panel display in accordance with an embodiment.
Figure 2:
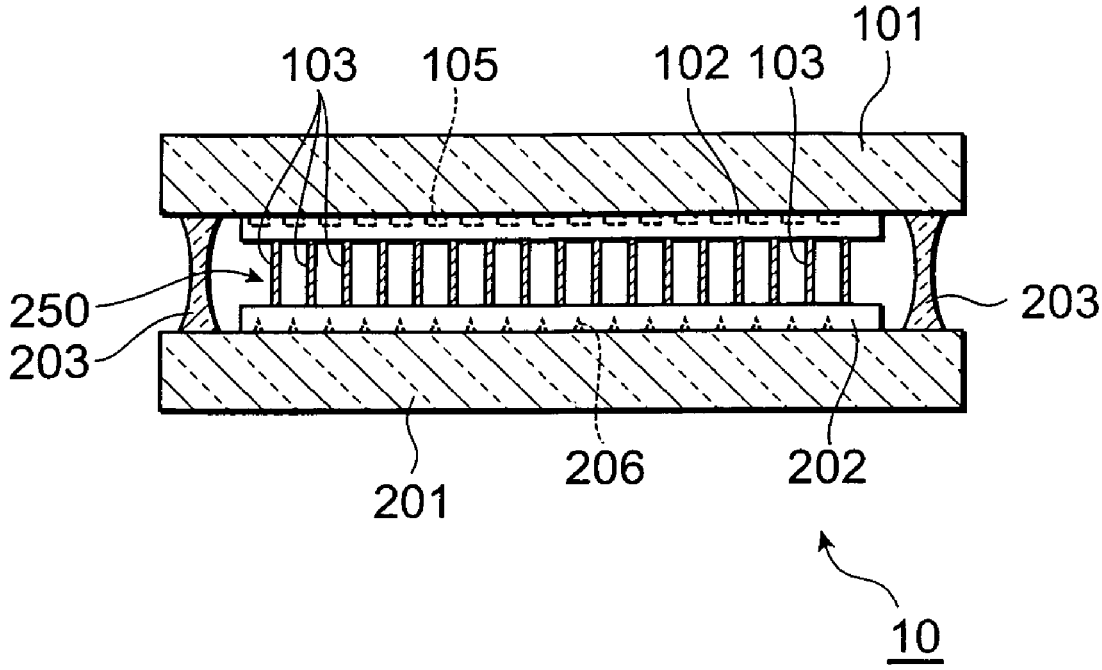
FIG. 2 is a sectional view of the flat panel display taken along the line II-II of FIG. 1.

FIG. 1 is a plan view of the flat panel display, whereas FIG. 2 is a sectional view of the flat panel display taken along the line II-II.

The flat panel display in accordance with this embodiment is a so-called FED (field emission display) and mainly comprises a faceplate 101, a backplate 201, and a number of flat panel display spacers 103.

The faceplate 101 is made of glass, and includes a lattice-like black matrix structure 102 and a plurality of fluorescent pixel areas 105, each containing a phosphorus layer, disposed within the lattices of the black matrix structure 102. The phosphorus layers of the fluorescent pixel areas 105 release light when a high-energy electron impinges thereon from the lower side in FIG. 2, thereby forming a visible display. The light emitted from the fluorescent pixel areas 105 is outputted to the outside (the depicted upper side) by way of the black matrix structure 102. The black matrix structure 102 functions as a lattice-like black structure for suppressing the mixing of respective light components from the fluorescent pixel areas 105 adjacent to each other.

The backplate 201 is a glass sheet, whereas a cathode structure 202 is formed on the backplate 201. The cathode structure 202 has a plurality of cathodes (field (electron) emission devices) 206 including projections for releasing electrons.

The area where the cathode structure 202 is formed in the backplate 201 is smaller than the area of the backplate 201. The area where the black matrix structure 102 is formed in the faceplate 101 is smaller than the area of the faceplate 101. A glass seal 203 is interposed between the outer peripheral region of the faceplate 101 and the outer peripheral region of the backplate 201, so as to provide a sealed chamber 250 at the center part. The pressure within the sealed chamber 250 is reduced to such an extent that electrons can fly. The glass seal 203 is formed by molten glass frit.

Between the black matrix structure 102 of the faceplate 101 and the cathode structure 202 of the backplate 201, a number of flat panel display spacers 103, each of which is a wall perpendicular to surfaces of these structures, are attached at predetermined intervals. The flat panel display spacers 103 will later be explained in detail.

The flat panel display spacers 103 uniformly keep the gap between the faceplate 101 and backplate 201. Arranged within the sealed chamber 250 are the cathode structure 202, the black matrix structure 102, and the flat panel display spacers 103. The thicknesses of the faceplate 101 and backplate 201 are about 300 μm and about 1000 μm, respectively, for example.

Examples of the faceplate 101 and backplate 201 include tempered glass and chemically tempered glass. These glass materials have a coefficient of thermal expansion of 8.0 to $9.3\times10^{-6}$/° C. in general.

A specific example of glass materials is PD200 (manufactured by Asahi Glass Co., Ltd.). PD200 has such a composition that $SiO_2$, $Al_2O_3$, $ZrO_2$, $Na_2O$, CaO, SrO, BaO, $ZrO_2$, $Na_2O$, and $K_2O$ are in a weight ratio of 58:7:2:5:7:8:3:4:6, and exhibits a coefficient of thermal expansion of $8.3\times10^{-6}$/° C. Also, for example, a glass material in which $SiO_2$, $Al_2O_3$, MgO, CaO, SrO, $Na_2O$, $K_2O$, and $TiO_2$ are in a weight ratio of 54:10:4:7:3:6:9:7 is favorably used as a glass disk for HDD, and exhibits a coefficient of thermal expansion of about $9.3\times10^{-6}$/° C. Further, for example, a glass material in which $SiO_2$, $Al_2O_3$, MgO, CaO, SrO, $Na_2O$, $K_2O$, and $TiO_2$ are in a weight ratio of 55:13:5:5:2:6:9:6 is favorably used as a glass disk for HDD, and exhibits a coefficient of thermal expansion of about $8.7-10^{-6}$/° C.

The flat panel display spacers 103 in the flat panel display 100 in accordance with this embodiment will now be explained in detail.

Figure 3:
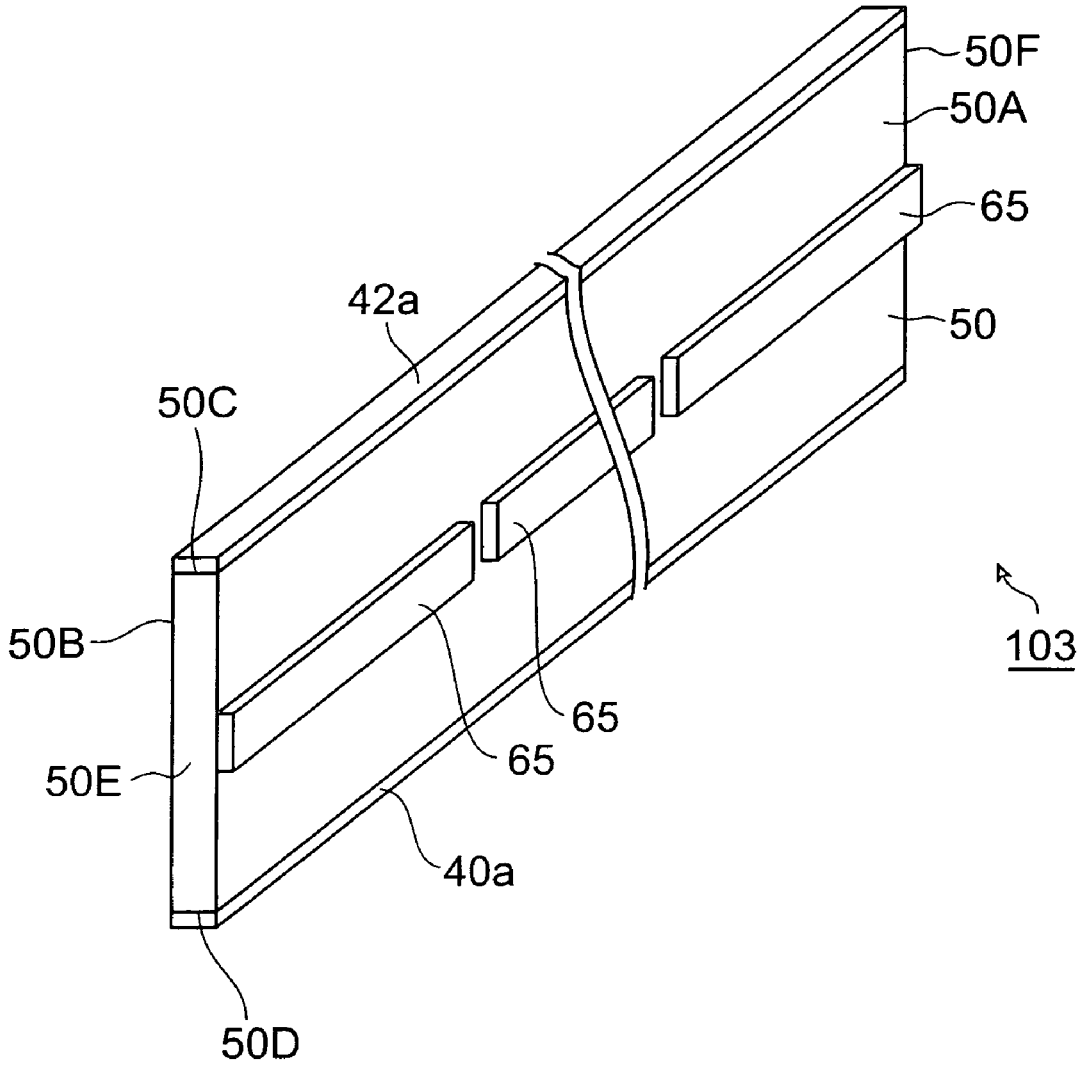
FIG. 3 is a perspective view of the flat panel display spacer in FIG. 1.

FIG. 3 is a perspective view showing the flat panel display spacer 103 in accordance with the present invention. The flat panel display spacer 103 is a substantially plate-like rectangular parallelepiped having main faces 50A, 50B; longitudinally extending side faces 50C, 50D; and longitudinal both end faces 50E, 50F.

The flat panel display spacer 103 includes a rectangular plate-like base (sintered body) 50 made of a sintered ceramic, a metal film 42*a* formed on the side face 50C of the base 50, and a metal film 40*a* formed on the side face 50D of the base 50. A patterned metal film 65 is formed on the main face 50A of the base 50. The metal film 65 extends along the longitudinal direction of the flat panel display spacer 103, while being separated and insulated from the metal films 40*a*, 42*a*. The metal film 65 is divided into a plurality of parts in the longitudinal direction. Specifically, the base 50 of the flat panel display spacer 103 has an outer form of about 0.08 mm×1.2 mm×120 mm, for example.

The metal films 40*a* and 42*a* reduce the in-plane unevenness in contact resistance against the cathode structure 202 of the backplate 201 and the black matrix structure 102 of the faceplate 101. The metal film 65 is used for ameliorating the inner electric field distribution of the flat panel display spacer 103.

Figure 4:
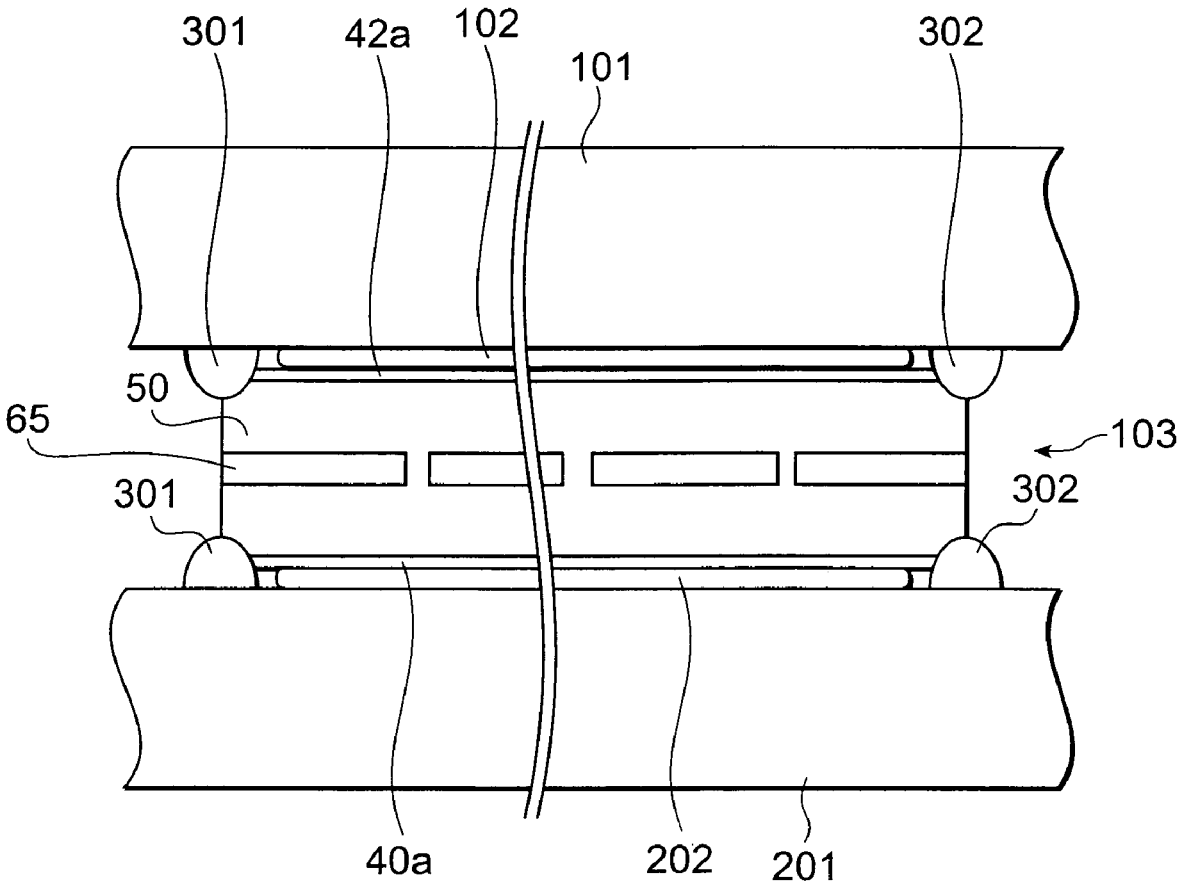
FIG. 4 is a view of the flat panel display taken along the line IV-IV of FIG. 1.

As shown in FIG. 4, the flat panel display spacer 103 is secured by adhesives 301, 302 provided at both longitudinal ends thereof to the faceplate 101 and backplate 201. Though the material for the adhesives 301, 302 in this example is a UV-curable polyimide adhesive, thermosetting adhesives or inorganic adhesives may be used. The adhesives 301, 302 are arranged on the outside of the black matrix structure 102 and cathode structure 202. Here, the metal films 40*a*, 42*a* of the flat panel display spacer 103 are arranged so as to be in contact with the cathode structure 202 of the backplate 201 and the black matrix structure 102 of the faceplate 101, respectively.

The base 50 of the flat panel display spacer 103 in accordance with this embodiment is a mixed ceramic sintered body containing $Al_2O_3$ (alumina), TiC (titanium carbide), MgO (magnesium oxide), and $TiO_2$ (titania), wherein the sintered body includes 35 to 55 wt % of MgO with respect to the total weight of $Al_2O_3$, TiC, MgO, and $TiO_2$.

Such a flat panel display spacer 103 yields a coefficient of thermal expansion of about 8.0 to $9.3\times10^{-6}$/° C. Therefore, the coefficient of thermal expansion of the flat panel display spacer 103 can sufficiently approach the coefficient of thermal expansion (about 8.0 to $9.3\times10^{-6}$/° C.) of the faceplate 101 and backplate 201 made of glass.

As a consequence, even when temperatures of the faceplate 101 and backplate 201 in the flat panel display and the flat panel display spacers 103 fluctuate, their respective rates of thermal expansion are on a par with each other. Therefore, even when the temperature varies among the faceplate 101, backplate 201, and flat panel display spacers 103 in the flat panel display 100, their rates of expansion are substantially at the same level. Hence, unnecessary distortions and the like are harder to occur in the flat panel display, whereby the flat panel display spacers 103 are less likely to misalign and tilt between the faceplate 101 and backplate 201. As a result, electrons released from the cathodes 206 of the cathode structure 202 can reach the fluorescent pixel areas 105 of the black matrix structure 102 without yielding any problems such as deflection, whereby the flat panel display 100 is restrained from deteriorating its image quality.

The base 50 of such a flat panel display spacer 103 is a mixed ceramic sintered body containing TiC and $Al_2O_3$, and thus also exhibits a property of AlTiC which is a conductive ceramic having a high hardness, thereby yielding a high strength.

Though the pressure within the flat panel display 100 is usually reduced, so that the atmospheric pressure applies a heavy load to the flat panel display spacer 103, the flat panel display spacer 103 can endure deformations caused by such a compressive force and can keep a predetermined gap between the faceplate 101 and backplate 201.

When the MgO content in the base 50 of the flat panel display spacer 103 is less than 35 wt %, the coefficient of thermal expansion tends to be too low. When the MgO content exceeds 55 wt %, on the other hand, the coefficient of thermal expansion tends to be too high.

When the coefficient of thermal expansion in the base 50 of the flat panel display spacer 103 is much more than $9.3\times10^{-6}$/° C. or far less than $8.0\times10^{-6}$/° C., for example, the difference in coefficient of thermal expansion from the faceplate 101 and backplate 201 made of glass increases, so that distortions and the like occur in the flat panel display 100 as the temperature changes, whereby the image quality is likely to deteriorate.

More preferably, the MgO content in the base 50 is 40 to 50 wt % with respect to the total weight of $Al_2O_3$, TiC, MgO, and $TiO_2$. This can make the coefficient of thermal expansion closer to that of the faceplate 101 or backplate 201, and thus can further suppress distortions of the flat panel display 100. Specifically, this yields a coefficient of thermal expansion of about 8.5 to $9.0\times10^{-6}$/° C. and is particularly preferred when using glass having a similar coefficient of thermal expansion.

Preferably, the amount of $TiO_2$ in the base 50 is 2.0 to 3.0 wt % with respect to the total weight of $Al_2O_3$, TiC, MgO, and $TiO_2$. In this case, the base 50 yields a resistivity on the order of $1.0\times10^{6}$ Ω·cm to $1.0\times10^{11}$ Ω·cm. As a consequence, the flat panel display 100 exhibits an appropriate conductivity, and is less likely to be electrostatically charged when an electric field is applied thereto, while being restrained from causing thermal runaway due to an overcurrent flow, thereby making it possible to further reduce distortions of images and the like therein. If the amount of $TiO_2$ is less than 2.0 wt % here, the resistivity will be so high that electrostatic charging is likely to occur when an electric field is applied. If the amount of $TiO_2$ exceeds 3.0 wt %, the resistivity may be so low that an overcurrent is likely to flow when an electric field is applied.

Preferably, the amount of TiC is 7.0 to 8.0 wt % with respect to the total weight of $Al_2O_3$, TiC, MgO, and $TiO_2$. This yields the flat panel display spacers 103 having a sufficient strength while being fully sintered. If the amount of TiC is less than 7.0 wt %, the rigidity may be so low that the strength tends to be insufficient. If the amount of TiC exceeds 8.0 wt %, the mixture may be harder to sinter, thereby tending to become fragile and worsen its strength again.

A method of manufacturing such a flat panel display 103 will now be explained.

Figure 5:
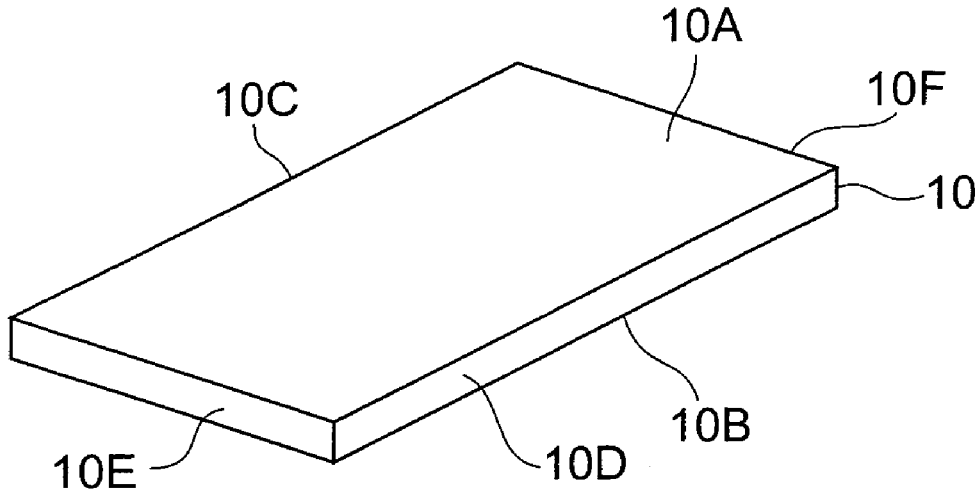
FIG. 5 is a view showing a method of manufacturing a flat panel display spacer.

First, as shown in (a) of FIG. 5, a plate 10 of a mixed ceramic sintered body containing $Al_2O_3$ (alumina), TiC (titanium carbide), MgO (magnesium oxide), and $TiO_2$ (titania) to become a material for a flat panel display spacer, in which the amount of MgO is 35 to 55 wt % with respect to the total weight of $Al_2O_3$, TiC, MgO, and $TiO_2$, is prepared.

Such a plate 10 is obtained by the steps of mixing powders of $Al_2O_3$, TiC, MgO, and $TiO_2$; molding the mixture; firing the molded body at a predetermined temperature; and leaving the fired body to cool.

First, the powders of $Al_2O_3$, TiC, MgO, and $TiO_2$ to become materials are prepared. Here, the $Al_2O_3$ powder as a material is preferably a fine powder, whereas its average particle size is preferably 0.1 to 1 μm, 0.4 to 0.6 μm in particular. The TiC powder is preferably a fine powder, whereas its average particle size is preferably 0.1 to 3 μm, 0.5 to 1.5 μm in particular. The MgO powder is preferably a fine powder, whereas its average particle size is preferably 0.1 to 3 μm, 0.5 to 1.5 μm in particular. The $TiO_2$ powder is preferably a fine powder, whereas its average particle size is preferably 0.1 to 3 μm, 0.5 to 1 μm in particular.

Then, these powders are mixed, so as to yield a mixed powder. Here, the powders are mixed such that the mixed powder contains 35 to 55 wt % of the MgO powder with respect to the total weight of $Al_2O_3$, TiC, MgO, and $TiO_2$ powders. Preferably, they are mixed such that the mixed powder contains about 40 to 50% of the MgO powder.

Preferably, in order for the resistivity to fall within a preferable range as mentioned above, the powders are mixed such that the mixed powder contains 2.0 to 3.0 wt % of $TiO_2$, though the amount of $TiO_2$ is not restricted in particular.

Preferably, in order to yield a spacer having a sufficient strength as mentioned above, the powders are mixed such that the mixed powder contains 7.0 to 8.0 wt % of TiC, though the amount of TiC is not restricted in particular.

Here, the powders are preferably mixed in a ball mill or attritor. For favorable mixing, it will be preferred if a solvent other than water, e.g., ethanol, IPA, or 95% denatured ethanol, is used. Preferably, the mixing is effected for about 10 to 100 hours. As a mixing medium in the ball mill or attritor, alumina balls or zirconia balls having a diameter of about 1 to 20 mm are preferably used, for example.

Next, the resulting mixed powder is granulated by spraying. For example, spray drying in a warm wind of an inert gas such as nitrogen or argon substantially free of oxygen at a temperature of about 60 to 200° C. is sufficient, which yields a granulated product of the mixed powder having the composition mentioned above. Here, it will be preferred if the granulated product has a particle size on the order of 50 μm to 200 μm, for example.

Then, a solvent and the like are added as necessary, so as to regulate the liquid content of the granulated product, such that the granulated product contains about 0.1 to 10 wt % of the solvent.

Next, a predetermined mold is filled with the granulated product, and primary molding is effected by cold pressing, so as to yield a molded body. Here, it will be sufficient if a mold made of a metal or carbon for forming a disk having an inner diameter of 150 mm, for example, is filled with the granulated product, and cold pressing is effected at a pressure of about 5 to 15 MPa (50 to 150 $kgf/cm^2$), for example.

Subsequently, the primarily molded body is hot-pressed, so as to yield a sintered body. Here, it will be preferred, for example, if the firing temperature is 1200 to 1700° C., the pressure is 10 to 50 MPa (100 to 500 $kgf/cm^2$), and the atmosphere is vacuum, nitrogen, or argon. The atmosphere is made nonoxidizing in order to prevent TiC from being oxidized. Preferably, a mold made of carbon is used. The sintering time is preferably about 1 to 3 hours.

After the exterior and the like are inspected, mechanical is effected by a diamond whetstone or the like, whereby a plate 10 to become a material for a flat panel display spacer is completed. The final plate 10 has a specific form of rectangular plate having a length of 134 mm, a width of 67 mm, and a thickness of 2.5 mm as shown in FIG. 5. The plate may also be a disk-shaped substrate having a diameter of 6 inches and a thickness of about 2 mm, for example.

A process of cutting a base 50 for a flat panel display spacer 103 from such a plate 10 will now be explained. Initially, the plate 10 is assumed to be a rectangular plate having main faces 10A, 10B, side faces 10C, 10D parallel to the longitudinal direction, and end faces 10E, 10F orthogonal to the longitudinal direction.

Figure 6:
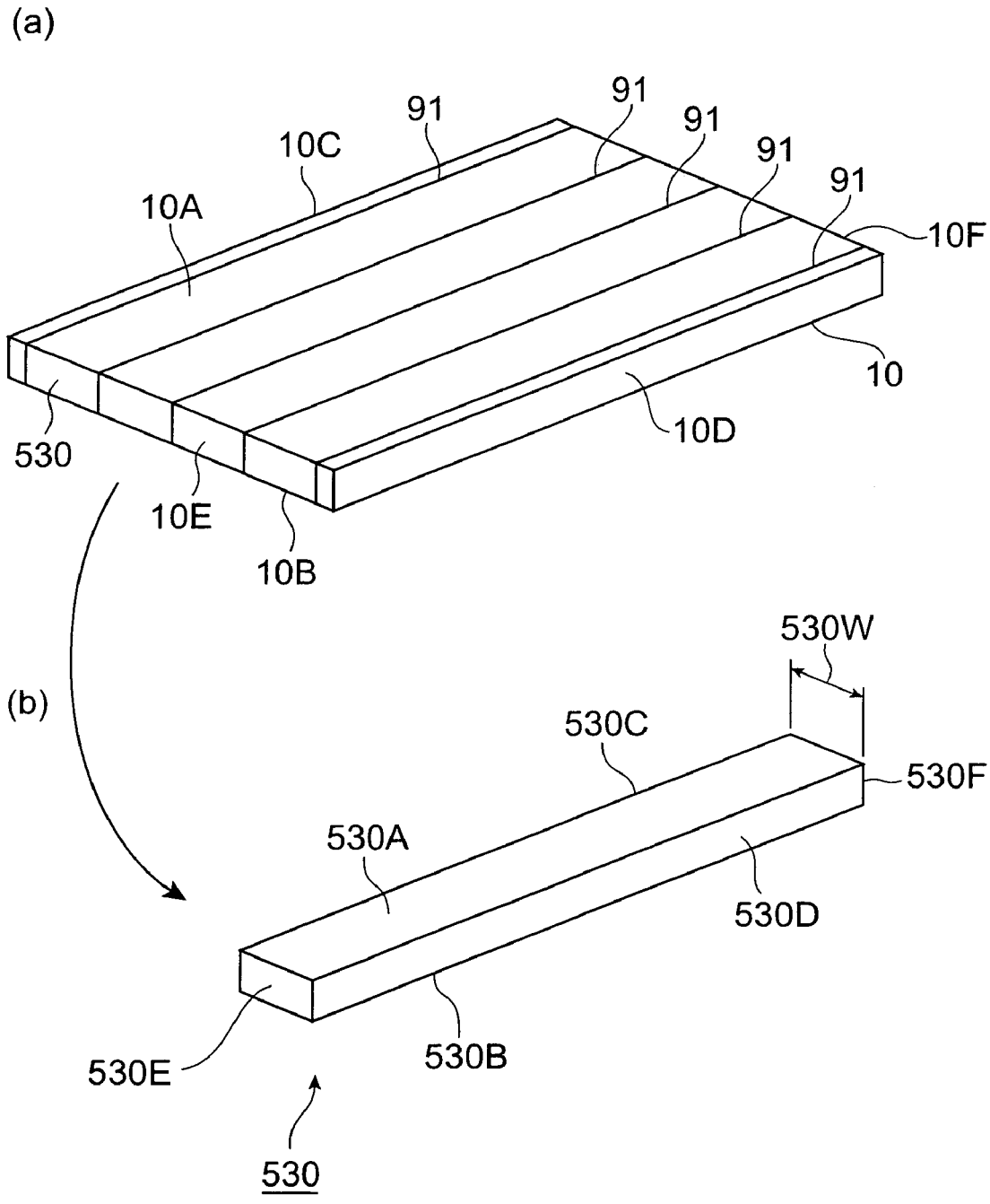
FIG. 6 is a perspective view, subsequent to FIG. 5, showing the method of manufacturing a flat panel display spacer.

First, as shown in (a) of FIG. 6, the plate 10 of a mixed ceramic sintered body is cut at predetermined intervals along a plurality of first cut sections 91 which are perpendicular to the main face 10A of the plate 10 and parallel to the side faces 10C, 10D of the plate 10. This forms first cut pieces 530 as shown in (b) of FIG. 6. Each of the first cut pieces 530 includes main faces 530A, 530B corresponding to the respective main faces 10A, 10B of the plate 10; side faces 530C, 530D corresponding to respective second cut sections 92; and end faces 530E, 530F corresponding to the respective end faces 10E, 10F of the plate 10 of the mixed ceramic sintered body. Subsequently, the side faces 530C, 530D of the first cut piece 530 are polished.

Figure 7:
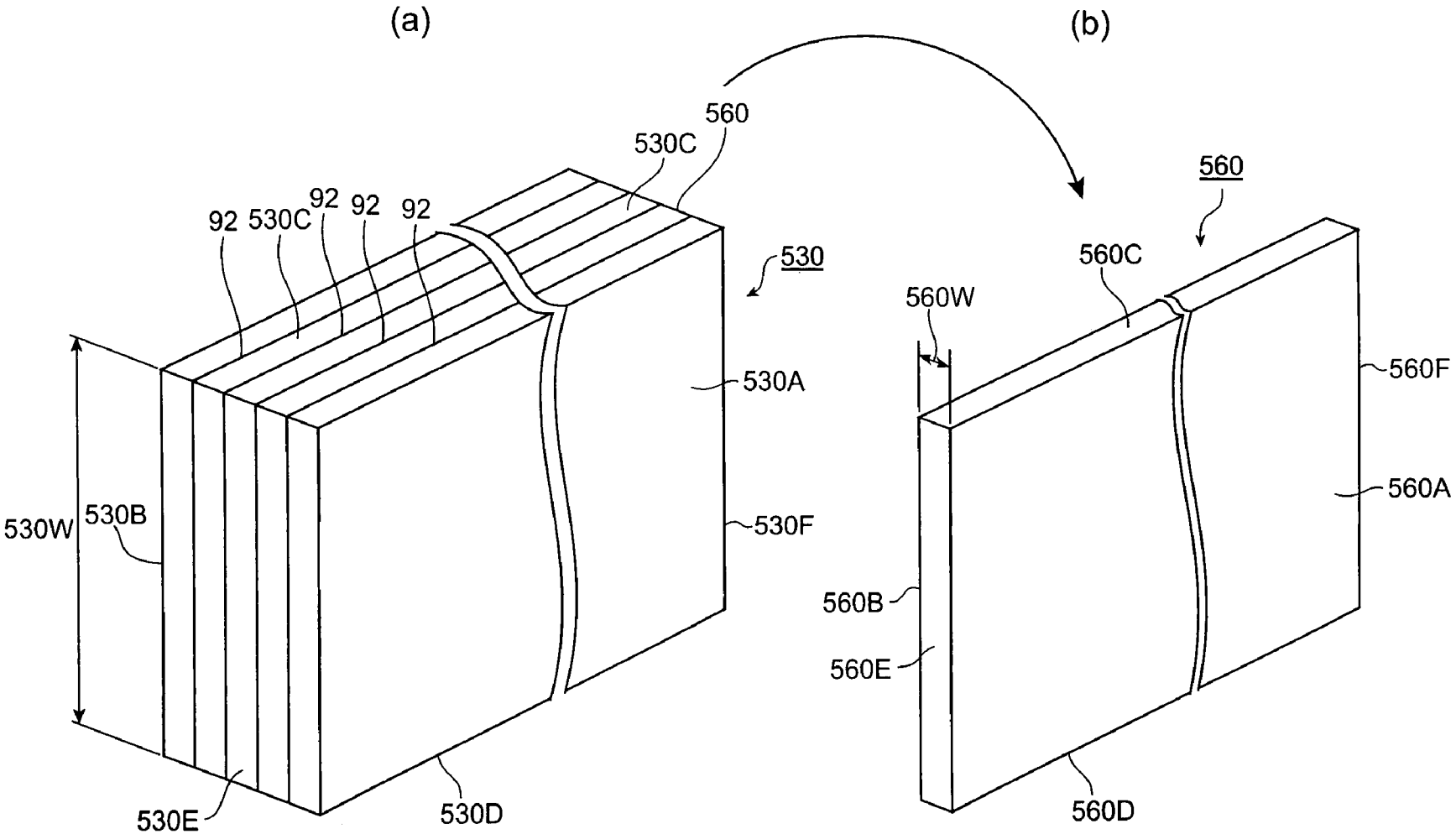
FIG. 7 is a perspective view, subsequent to FIG. 6, for explaining the manufacturing method in accordance with the embodiment.

Next, as shown in (a) of FIG. 7, the first cut piece 530 is cut at predetermined intervals along a plurality of second cut sections 92 parallel to the main face 530A of the first cut piece 530, so as to yield second cut pieces 560 as shown in (b) of FIG. 7.

Each of the second cut pieces 560 includes main faces 560A, 560B corresponding to the respective second cut sections 92; side faces 560C, 560D extending in the longitudinal direction; and end faces 560E, 560F at both longitudinal ends. The first cut piece 530 is cut such that the gap 560W between the main faces 560A and 560B of the second cut piece 560 is narrower than the width 530W of the first cut piece 530.

Figure 8:
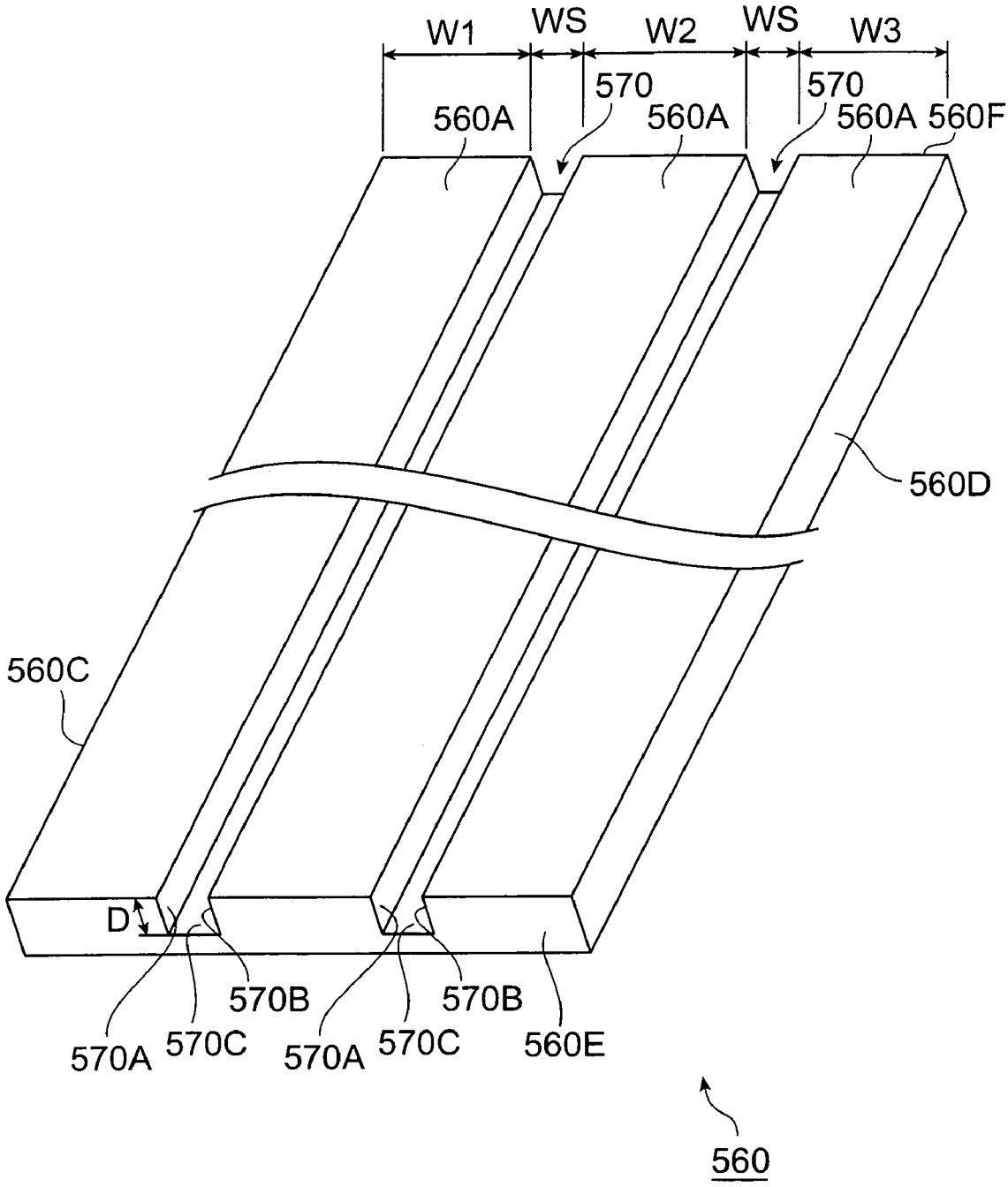
FIG. 8 is a perspective view, subsequent to FIG. 7, showing the method of manufacturing a flat panel display spacer.

Subsequently, as shown in FIG. 8, a plurality of grooves 570 extending from the end face 560E to the end face 560F in parallel with a direction along which the side faces 560C, 560D extend are formed at predetermined intervals. Here, the distance W2 between the grooves 570, the distance W3 between the groove 570 closest to the side face 560D and the side face 560D, and the distance W1 between the groove 570 closest to the side face 560C and the side face 560C are the same. Each groove 570 is formed by side walls 570A and 570B parallel to the side face 560D and a bottom face 570C connecting respective lower ends of the side walls 570A and 570B, and has a rectangular cross section. The groove 570 has a predetermined width WS and a predetermined depth D. The width WS and depth D may be about 10 to 200 μm and about 100 to 200 μm, respectively, for example.

Figure 9:
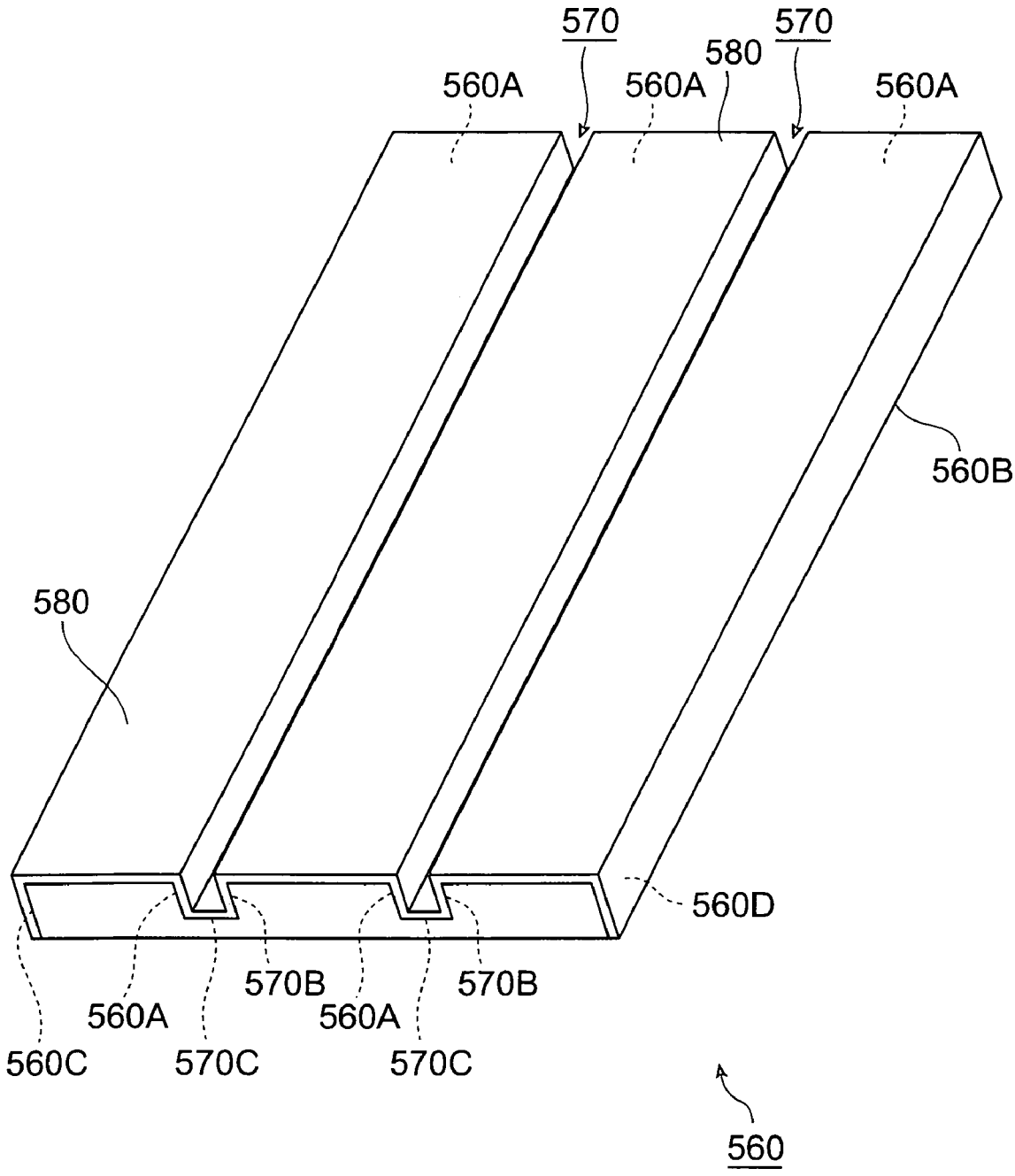
FIG. 9 is a perspective view, subsequent to FIG. 8, showing the method of manufacturing a flat panel display spacer.

Next, as shown in FIG. 9, atoms, fine particles, and the like of metals such as Ti, Au, Cr, and Pt are sprayed to the second cut piece 560 from the side of the main face 560A formed with the grooves 570. This forms a metal film. 580 having a thickness of several nm to 1.0 μm over the side faces 560C, 560D, main face 560A, and surfaces within the grooves 570 in the second cut piece 560.

Figure 10:
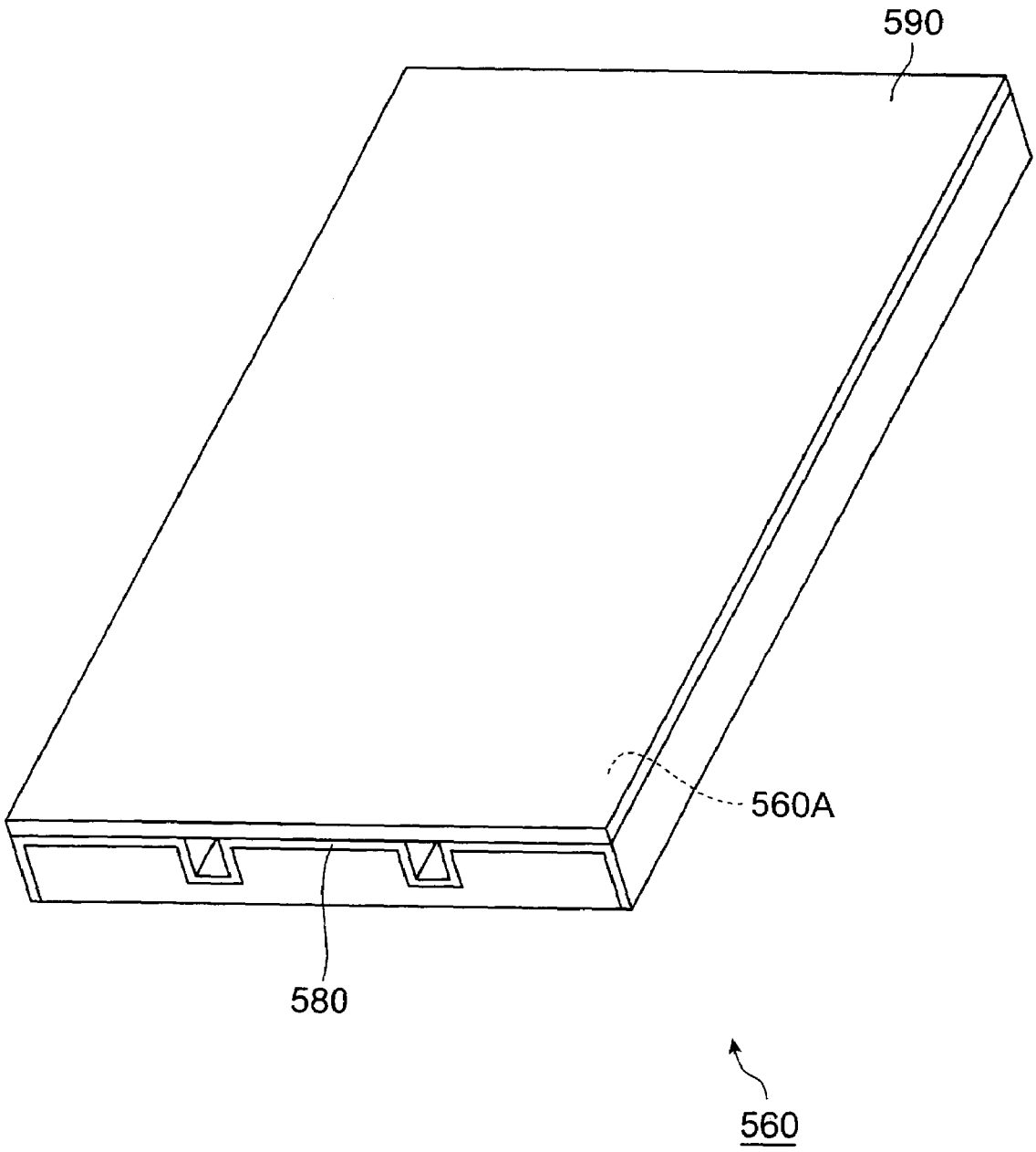
FIG. 10 is a perspective view, subsequent to FIG. 9, showing the method of manufacturing a flat panel display spacer.
Figure 11:
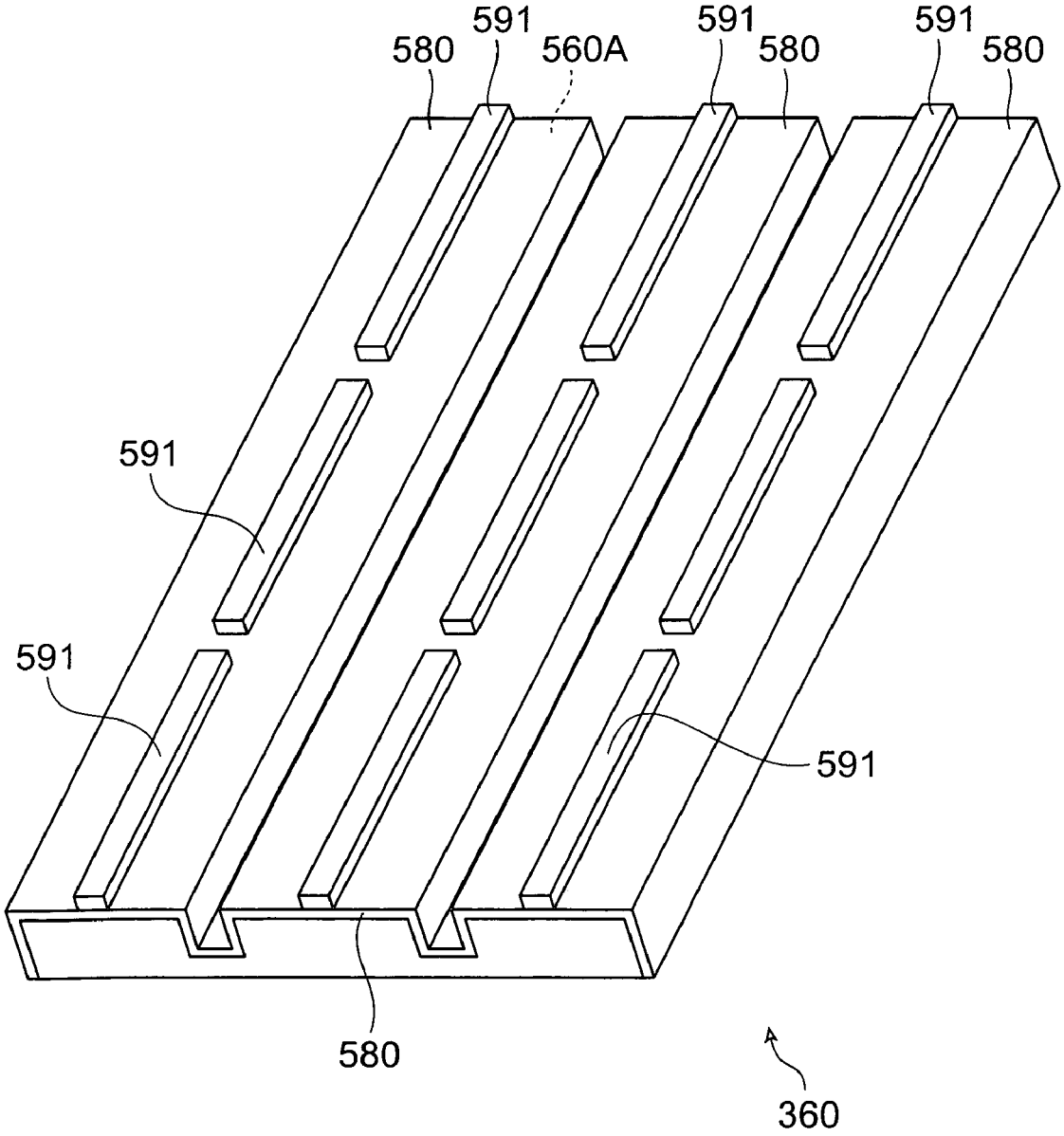
FIG. 11 is a perspective view, subsequent to FIG. 10, showing the method of manufacturing a flat panel display spacer.

Subsequently, as shown in FIG. 10, a film resist 590 is attached under heat and pressure onto the part of metal film 580 on the main face 560A of the second cut piece 560. Then, the film resist 590 is exposed to light through a predetermined mask and developed, so as to be patterned into resist patterns 591 as shown in FIG. 11, thereby partly exposing the metal film 580.

Figure 12:
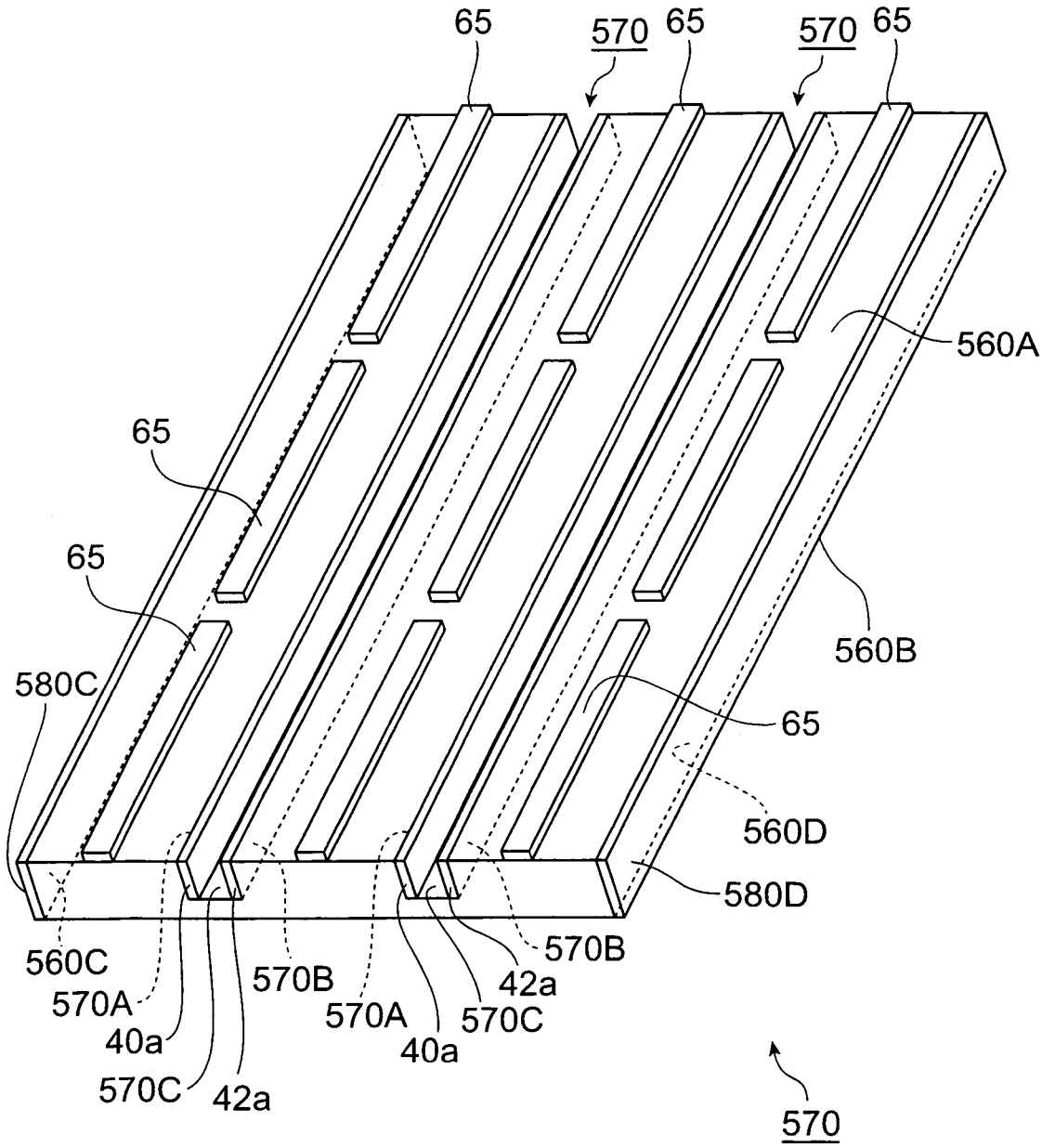
FIG. 12 is a perspective view, subsequent to FIG. 11, showing the method of manufacturing a flat panel display spacer.

Then, by ion milling or the like, the metal film 580 is removed by a predetermined thickness as shown in FIG. 12 while using the resist patterns 591 as a mask. Here, the predetermined thickness is set such that the part of metal film 580 formed on the main face 560A can completely be removed. This simultaneously removes the part of metal film 580 provided on the bottom faces 570C of the grooves 570. This forms a metal film 580C on the side face 560C of the second cut piece 560, a metal film 580D on the side face 560D, a meal film 40*a* on each of the side walls 570A of the grooves 570, and a metal film 42*a* on each of the side walls 570B of the grooves 570. A patterned metal film 65 is formed on the main face 560A of the second cut piece 560.

Figure 13:
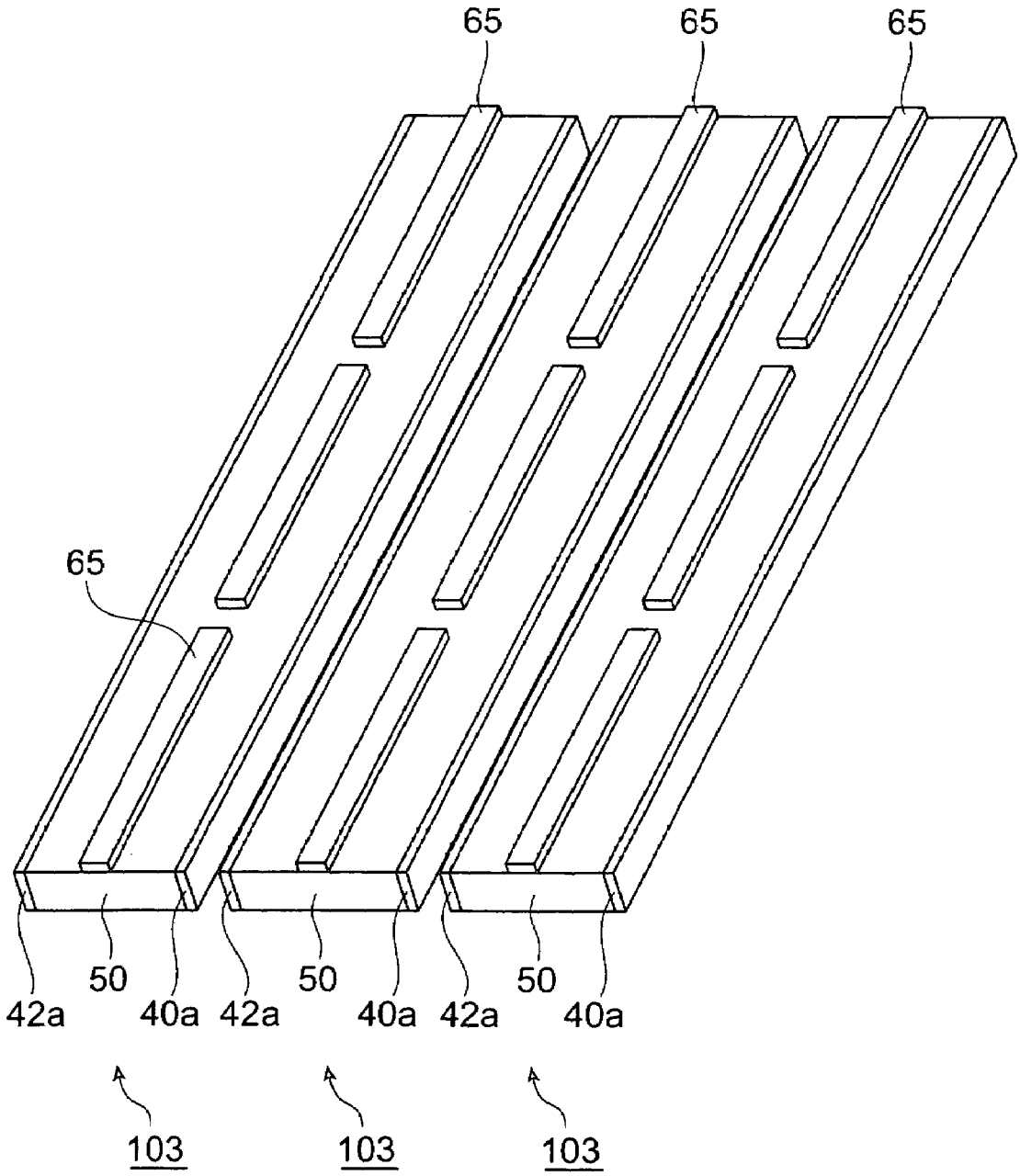
FIG. 13 is a perspective view, subsequent to FIG. 12, showing the method of manufacturing a flat panel display spacer.

Next, the second cut piece 560 is polished from the rear face thereof, i.e., from the main face 560B side, to the grooves 570, so as to divide the second cut piece 560 into a plurality of pieces, thereby yielding flat panel display spacers 103 as shown in FIG. 13. Here, in the process of polishing, the metal film 580C becomes the metal film 42*a*, the metal film 580D becomes the metal film 40*a*, and the second cut piece 560 is divided into bases 50.

Then, such a flat panel display spacer 103 is attached by bonding or the like between a black matrix structure 102 of a faceplate 101 and a cathode structure 202 of a backplate 201 so as to be perpendicular to their surfaces, whereby the above-mentioned flat panel display 100 can be made. Here, the faceplate 101 having the black matrix structure 102 and the backplate 201 having the cathode structure 202 can be produced by a known method.

EXAMPLES

Examples in accordance with this embodiment will now be explained.

Example 1

First, respective predetermined amounts of $Al_2O_3$ powder (having an average particle size of 0.5 μm and a purity of 99.9%), TiC powder (having an average particle size of 0.5 μm, a purity of 99%, and a carbon content of at least 19% including 1% or less of free graphite), MgO powder (having an average particle size of 0.1 μm), and $TiO_2$ powder (having an average particle size of 0.1 μm) were weighed, pulverized and mixed with ethanol for 30 minutes in a ball mill, and granulated by spraying in nitrogen at 150° C., so as to yield a granulated product. Here, the composition of the granulated product was adjusted such that the respective contents of $Al_2O_3$, TiC, MgO, and $TiO_2$ powders were 55.5 wt %, 7.0 wt %, 35.0 wt %, and 2.5 wt % with respect to the total weight of the $Al_2O_3$, TiC, MgO, and $TiO_2$ powders.

Subsequently, thus obtained mixture was primarily molded at about 0.5 MPa (50 kgf/cm$^2$), and fired by hot pressing in a vacuum atmosphere for 1 hour at a sintering temperature of 1600° C. under a pressing pressure of about 30 MPa (about 300 kgf/cm$^2$), so as to yield a plate for a spacer in Example 1.

Examples 2 to 5

A plate for a spacer in Example 2 was obtained as in Example 1 except that the respective contents of $Al_2O_3$ and MgO powders were 50.5 wt % and 40.0 wt %. A plate for a spacer in Example 3 was obtained as in Example 1 except that the respective contents of $Al_2O_3$ and MgO powders were 45.5 wt % and 45.0 wt %. A plate for a spacer in Example 4 was obtained as in Example 1 except that the respective contents of $Al_2O_3$ and MgO powders were 40.5 wt % and 50.0 wt %. A plate for a spacer in Example 5 was obtained as in Example 1 except that the respective contents of $Al_2O_3$ and MgO powders were 35.5 wt % and 55.0 wt %.

Comparative Examples 1 and 2

A plate for a spacer in Comparative Example 1 was obtained as in Example 1 except that the respective contents of $Al_2O_3$ and MgO powders were 60.5 wt % and 30.0 wt %. A plate for a spacer in Comparative Example 2 was obtained as in Example 1 except that the respective contents of $Al_2O_3$ and MgO powders were 30.5 wt % and 60.0 wt %.

Examples 6 to 9

A plate for a spacer in Example 6 was obtained as in Example 2 except that the respective contents of $Al_2O_3$ and $TiO_2$ powders were 51.5 wt % and 1.5 wt %. A plate for a spacer in Example 7 was obtained as in Example 2 except that the respective contents of $Al_2O_3$ and $TiO_2$ powders were 51.0 wt % and 2.0 wt %. A plate for a spacer in Example 8 was obtained as in Example 2 except that the respective contents of $Al_2O_3$ and $TiO_2$ powders were 50.0 wt % and 3.0 wt %. A plate for a spacer in Example 9 was obtained as in Example 2 except that the respective contents of $Al_2O_3$ and $TiO_2$ powders were 49.5 wt % and 3.5 wt %.

Examples 10 to 12

A plate for a spacer in Example 10 was obtained as in Example 2 except that the respective contents of $Al_2O_3$ and TiC powders were 51.5 wt % and 6.0 wt %. A plate for a spacer in Example 11 was obtained as in Example 2 except that the respective contents of $Al_2O_3$ and TiC powders were 49.5 wt % and 8.0 wt %. A plate for a spacer in Example 12 was obtained as in Example 2 except that the respective contents of $Al_2O_3$ and TiC powders were 48.5 wt % and 9.0 wt %.

Figure 15:
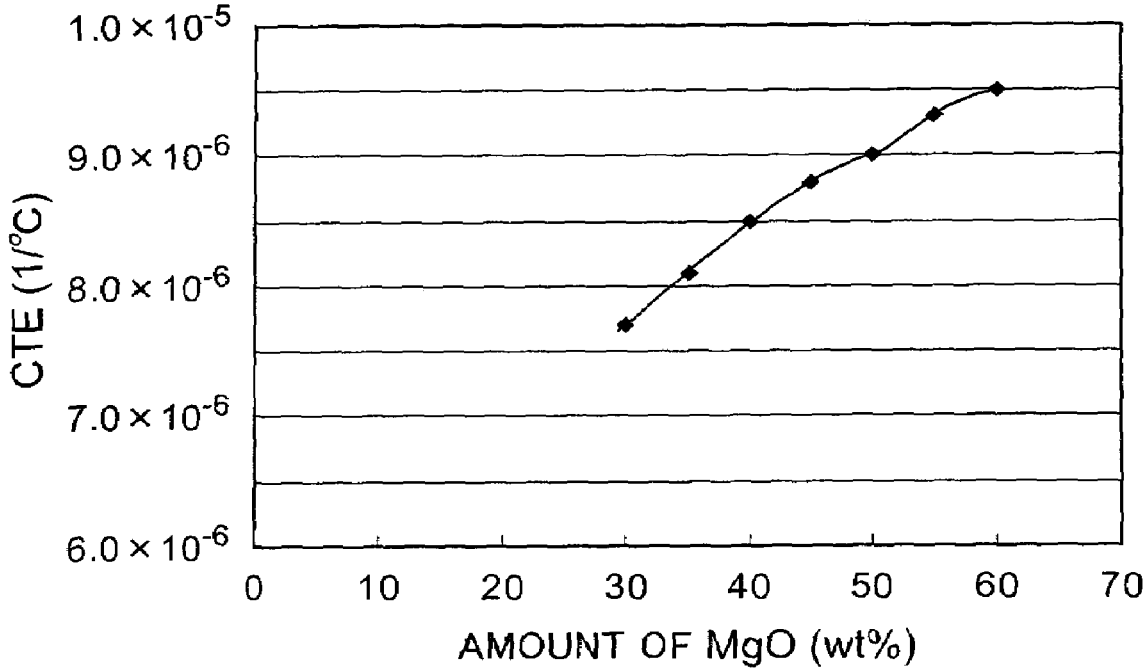
FIG. 15 is a graph showing the relationship between the amount of addition of MgO and the coefficient of thermal expansion in Examples 1 to 12 and Comparative Examples 1 and 2.
Figure 16:
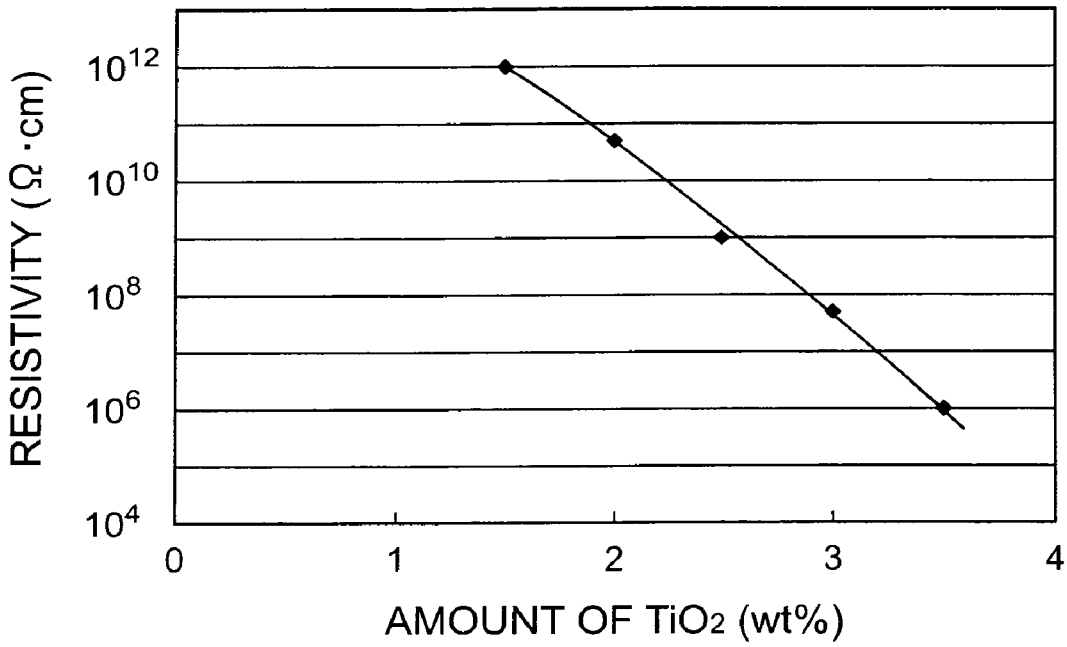
FIG. 16 is a graph showing the relationship between the amount of addition of $TiO_2$ and the coefficient of thermal expansion in Examples 1 to 12 and Comparative Examples 1 and 2.
Figure 17:
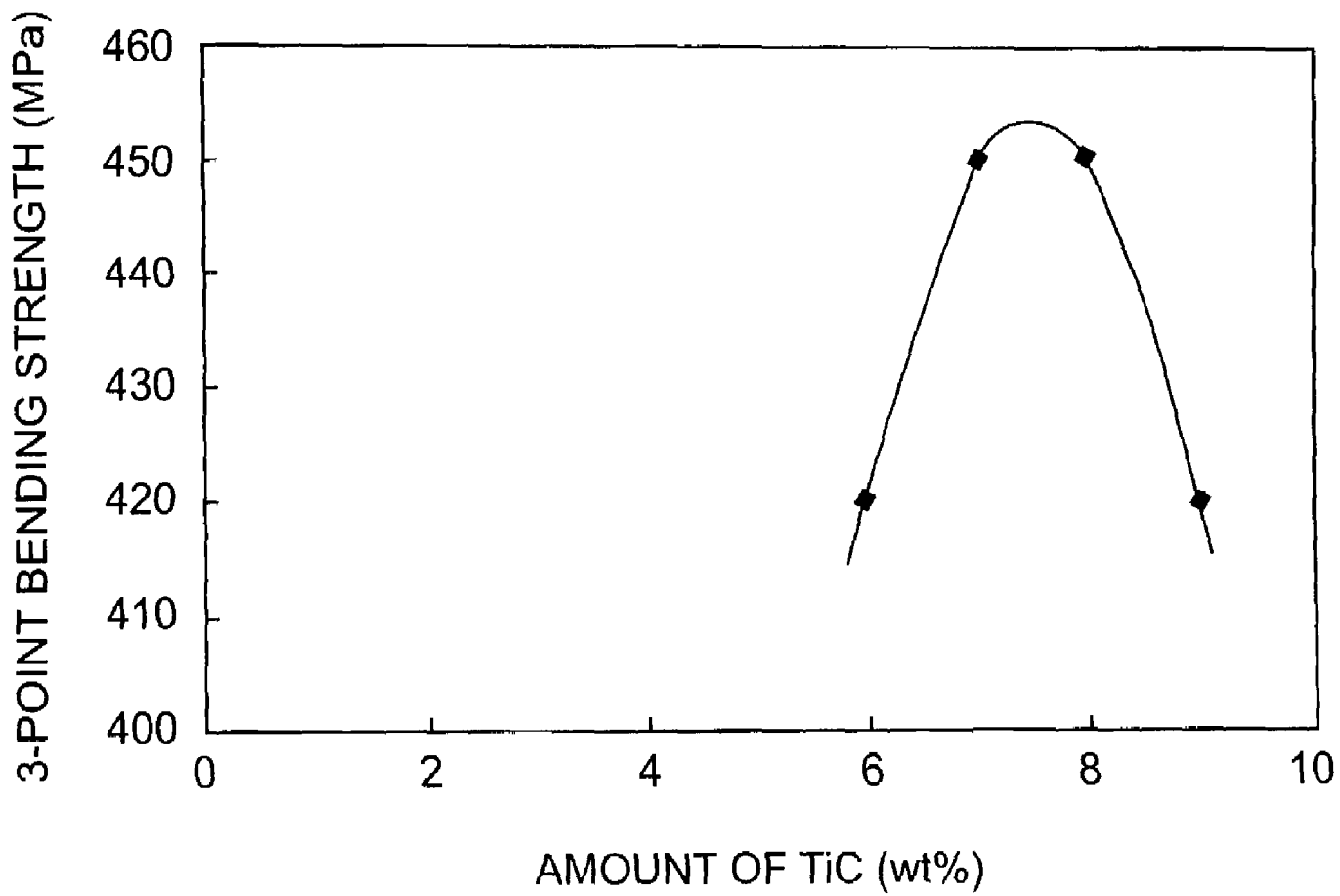
FIG. 17 is a graph showing the relationship between the amount of addition of TiC and the 3-point bending strength in Examples 1 to 12 and Comparative Examples 1 and 2.

The table of FIG. 1 shows the amounts of individual components added and values of coefficient of thermal expansion, resistivity, and 3-point bending strength in Examples 1 to 12 and Comparative Examples 1 and 2. FIGS. 14, 15, and 16 show the relationship between the amount of addition of MgO and the coefficient of thermal expansion, the relationship between the amount of addition of $TiO_2$ and the resistivity, and the relationship between the TiC content and the 3-point bending strength, respectively.

The resistivity was measured by using a digital multimeter manufactured by Advantest, while applying an electric field of 10000 V/mm to each plate for a spacer. The 3-point bending strength was measured by an autograph material testing machine manufactured by Shimadzu Corporation with a span of 30 mm and a crosshead speed of 0.1 mm/min.

As can be seen from FIG. 15, the coefficient of thermal expansion is about 8.0 to $9.3\times10^{-6}/°$ C. when the MgO content is 35 to 55 wt % as in Examples 1 to 12. As can be seen from FIG. 15, the resistivity is about $1.0\times10^{6}$ to $1.0\times10^{10}$ Ω·cm when the $TiO_2$ content is 2.0 to 3.0 wt % as in Examples 1 to 5, 7, 8, and 10 to 12. For yielding a spacer having a strength of at least 400 MPa which is usually considered favorable, it will be preferred if the TiC content is 7 to 8% as can be seen from FIG. 16. Sinterability seems to decreases when the TiC concentration is too high, thereby lowering the strength.

The invention claimed is:

1. A flat panel display spacer having a sintered body containing $Al_2O_3$, TiC, MgO, and $TiO_2$; wherein the sintered body includes 35 to 55 wt % of MgO with respect to the total weight of $Al_2O_3$, TiC, MgO, and $TiO_2$.

2. A flat panel display spacer according to claim 1, wherein the sintered body contains 2.0 to 3.0 wt % of $TiO_2$ with respect to the total weight of $Al_2O_3$, TiC, MgO, and $TiO_2$.

3. A flat panel display spacer according to claim 1, wherein the sintered body contains 7.0 to 8.0 wt % of TiC with respect to the total weight of $Al_2O_3$, TiC, MgO, and $TiO_2$.

4. A method of manufacturing a flat panel display spacer, the method comprising the steps of:

mixing powders of $Al_2O_3$, TIC, MgO, and $TiO_2$ such that the MgO powder is 35 to 55 wt % with respect to the total weight of powders of $Al_2O_3$, TiC, MgO, and $TiO_2$, so as to yield a mixture; and firing the mixture, so as to yield a sintered body.

5. A flat panel display comprising:

a backplate including a cathode structure;

a faceplate including a fluorescent pixel area; and a flat panel display spacer interposed between the backplate and the faceplate and formed from a sintered body containing $Al_2O_3$, TiC, MgO, and $TiO_2$, wherein the sintered body includes 35 to 55 wt % of MgO with respect to the total weight of $Al_2O_3$, TiC, MgO, and $TiO_2$.

6. A flat panel display spacer according to claim 1, wherein the sintered body contains 2.0 to 3.0 wt % of $TiO_2$, with respect to the total weight of $Al_2O_3$, TiC, MgO, and $TiO_2$; and wherein the sintered body contains 7.0 to 8.0 wt % of TiC with respect to the total weight of $Al_2O_3$, TiC, MgO, and $TiO_2$.

* * * * *